US009214307B2

(12) United States Patent
Koch et al.

(10) Patent No.: US 9,214,307 B2
(45) Date of Patent: Dec. 15, 2015

(54) OPERATING ELEMENT FOR A FURNITURE CONTROL AND ELECTRICALLY ADJUSTABLE PIECE OF FURNITURE

(71) Applicant: LOGICDATA Electronic & Software Entwicklungs GmbH, Deutschlandsberg (AT)

(72) Inventors: Walter Koch, Schwanberg (AT); Stefan Lukas, Preding (AT)

(73) Assignee: LOGICDATA Electronic & Software Entwicklungs GmbH, Deutschlandsberg (AT)

( * ) Notice: Subject to any disclaimer, the term of this patent is extended or adjusted under 35 U.S.C. 154(b) by 484 days.

(21) Appl. No.: 13/686,755

(22) Filed: Nov. 27, 2012

(65) Prior Publication Data

US 2013/0169065 A1 Jul. 4, 2013

Related U.S. Application Data

(63) Continuation-in-part of application No. PCT/EP2012/059626, filed on May 23, 2012.

(30) Foreign Application Priority Data

May 24, 2011 (DE) ..... 10 2011 102 439

(51) Int. Cl.

| | |
|---|---|
| ***H01H 35/00*** | (2006.01) |
| ***H01H 47/00*** | (2006.01) |
| ***A47C 31/00*** | (2006.01) |

(52) U.S. Cl.
CPC ..... *H01H 47/00* (2013.01); *A47C 31/008* (2013.01); *Y10T 307/76* (2015.04)

(58) Field of Classification Search
CPC ..... H03K 17/962
USPC ..... 307/116
See application file for complete search history.

(56) References Cited

U.S. PATENT DOCUMENTS

| | | | | |
|---|---|---|---|---|
| 6,021,533 | A * | 2/2000 | Ellis et al. | 5/600 |
| 6,693,552 | B1 | 2/2004 | Herzig et al. | |
| 8,717,181 | B2 * | 5/2014 | Tallent et al. | 340/573.4 |
| 2002/0144886 | A1 | 10/2002 | Engelmann et al. | |
| 2006/0181154 | A1 | 8/2006 | Ratner et al. | |
| 2007/0101500 | A1 | 5/2007 | Fruh et al. | |
| 2013/0169065 | A1 | 7/2013 | Koch et al. | |

FOREIGN PATENT DOCUMENTS

| | | | |
|---|---|---|---|
| AT | 500128 | A1 | 10/2005 |
| DE | 3910977 | A1 | 10/1990 |

(Continued)

*Primary Examiner* — Stephen W Jackson
(74) *Attorney, Agent, or Firm* — Slater & Matsil, L.L.P.

(57) ABSTRACT

In an operating element for a furniture control for controlling an electrically adjustable piece of furniture, the operating element includes a flat sensor module with a plurality of proximity-sensitive sensor surfaces arranged on the sensor module. An operating panel covers the plurality of sensor surfaces. A set of switching surfaces is marked on the operating panel. A control module is designed for detecting an actuation of one of the switching surfaces based on sensor signals delivered by the sensor surfaces and for generating an actuation signal for the furniture control based on a detected actuation. The sensor module and the control module are arranged in a housing of the operating element, wherein the operating panel forms a cover of the housing.

21 Claims, 5 Drawing Sheets

(56) References Cited

FOREIGN PATENT DOCUMENTS

| | | | |
|---|---|---|---|
| DE | 10117956 | A1 | 10/2002 |
| DE | 202006018448 | U1 | 3/2007 |
| DE | 102008043126 | A1 | 7/2010 |
| DE | 102010024592 | A1 | 12/2011 |
| DE | 102011102439 | A1 | 11/2012 |
| EP | 1076347 | A2 | 2/2001 |
| WO | WO 2005/019987 | A2 | 3/2005 |
| WO | WO 2007/054096 | A1 | 5/2007 |
| WO | WO 2007/124754 | A2 | 11/2007 |
| WO | WO 2008/128250 | A1 | 10/2008 |

* cited by examiner

OPERATING ELEMENT FOR A FURNITURE CONTROL AND ELECTRICALLY ADJUSTABLE PIECE OF FURNITURE

This application is a continuation-in-part of co-pending International Application No. PCT/EP2012/059626, filed May 23, 2012, which designated the United States and was not published in English, and which claims priority to German Application No. 10 2011 102 439.9, filed May 24, 2011, both of which applications are incorporated herein by reference.

TECHNICAL FIELD

The invention pertains to an operating element for a furniture control for controlling an electrically adjustable piece of furniture, as well as to an electrically adjustable piece of furniture with such an operating element.

BACKGROUND

Adjustable pieces of furniture, particularly electrically adjustable pieces of furniture, are nowadays widely used. For example, there exist tables such as, in particular, work tables or desks that can be electrically adjusted with respect to their height or the inclination of their table top. Other examples of known electrically adjustable pieces of furniture are beds such as hospital beds, in which the inclination of the bed surface can be adjusted, and chairs or armchairs, in which the inclination of a backrest can be electrically adjusted.

In addition to corresponding adjusting motors and a control for the actuation of these motors, operating elements or operating devices are provided in order to enable a user of the piece of furniture to carry out the desired adjustments. Such an operating element may be integrated into a control or arranged remotely of the control such that the operating element can be individually positioned.

In conventional operating elements, the design of an operating interface for the user usually is predetermined, for example, by the fixed positioning of key elements in the operating element such that, among other things, the layout of a circuit board, on which the key elements are mounted, and the design of a housing of the operating element are also predetermined. If a customer desires an individual or deviating design of the operating element, a new circuit board needs to be designed and manufactured and, for example, a new injection mold needs to be provided for the housing. This increases the production costs for individually adapted operating elements.

SUMMARY OF THE INVENTION

In one aspect, a flexible concept for the design of an operating element for a furniture control allows an individually adapted operation of the operating element.

According to one embodiment, an operating element for a furniture control for controlling an electrically adjustable piece of furniture is proposed. The operating element comprises a flat sensor module with a plurality of proximity-sensitive sensor surfaces, an operating panel, on which a set of switching surfaces is marked, for covering the plurality of sensor surfaces, as well as a control module that is designed for detecting an actuation of one of the switching surfaces based on sensor signals delivered by the sensor surfaces and for generating an actuation signal for the furniture control based on a detected actuation. The operating element furthermore comprises a housing, in which the sensor module and the control module are arranged, wherein the operating panel forms a cover of the housing.

The sensor module is arranged, for example, between the operating panel and the control module. In this case, it is preferred to arrange the operating panel directly above the sensor module, particularly such that it is in direct contact with the sensor module. The switching surfaces marked on the operating panel are visible, in particular, on the outside of the housing and provided, for example, on the side of the operating panel that faces away from the sensor module.

In various embodiments, the control module features a microcontroller that is electrically coupled to the sensor surfaces such that it can evaluate the corresponding sensor signals of the connected sensor surfaces.

During an actuation of one of the switching surfaces, the user of the operating element only comes in contact with the operating panel, not with the sensor module or the sensor surfaces that are covered by the operating panel.

The detection of an actuation of one of the switching surfaces is based on the principle of detecting the vicinity of a body part, particularly a finger, in relation to one or more sensor surfaces. The sensors formed by the sensor surfaces are based, for example, on a resistive measurement, a surface acoustic wave measurement, a capacitive measurement or the like. In various embodiments, the sensor surfaces respectively form a capacitive sensor. It would be possible, in particular, to realize the sensor surfaces with a plurality of electrodes that are arranged on the sensor module in a grid-like fashion. In this case, it is preferred that each sensor surface is respectively formed by one electrode. The sensor surfaces or electrodes therefore are arranged, for example, adjacent to one another on the sensor module.

The control module or a microcontroller of the control module is respectively designed, for example, for detecting a change of the capacitance value of each of the sensor surfaces or electrodes when a finger of a user moves over the operating panel or the sensor module, respectively. For example, the capacitance value of each of the electrodes or sensor surfaces is measured and the position of the finger is determined based on the measured capacitance values. In this case, not only one capacitance value of one sensor surface can be used for determining the position, but also several capacitance values, in particular, of adjacent sensor surfaces that lie underneath one of the switching surfaces on the operating panel.

According to one embodiment, each switching surface of the set of switching surfaces covers a group of sensor surfaces of the plurality of sensor surfaces. For example, such a group comprises one or more sensor surfaces that are covered, for example, by the corresponding switching surface. The sensor surfaces of such a group may be covered completely or at least partially. The degree, by which a sensor surface of such a group is covered by the switching surface lying thereon, may define, for example, the capacitance value that should be reached or approximately reached together with the other capacitance values of the group in order to detect an actuation of the corresponding switching surface.

In one embodiment, the control module is designed for detecting an actuation of one of the switching surfaces based on the detection parameters that define a correlation between each of the switching surfaces and a corresponding group of sensor surfaces, the sensor signals of which serve for detecting the actuation of this switching surface. In various embodiments, such detection parameters are evaluated by a microcontroller of the control module. The detection parameters comprise, for example, information on which of the sensor surfaces are assigned to a certain switching surface, as well as the covering ratios or capacitance ratios of these sensor surfaces referred to the corresponding switching surface. Such detection parameters are stored, for example, in a parameter memory that may be integrated into the microcontroller or provided on the control module separately of the microcontroller. The actual operating program of the microcontroller contains a detection algorithm that uses the stored detection parameters for evaluating the sensor signals and may be stored in a separate program memory. Such a program may be integrated, for example, in firmware of the control module.

In various embodiments, the control module may also feature an external interface, by means of which the detection parameters can be respectively read out and transferred to the control module. Such an interface may be realized, e.g., in the form of a serial interface, a USB interface or even a wireless interface. Such an interface respectively enables a user and a furniture manufacturer to carry out an individual and adapted parameterization of the detection parameters in dependence on the design of the operating panel, particularly the positioning of the switching surfaces on the operating panel. Due to the separation of the operating program and the detection parameters, it is also possible to respectively prevent the control module or the operating element from being rendered unusable if the parameterization is incorrect. It would furthermore be possible that the operating panel features a memory for storing the detection parameters, wherein the control module is designed for reading out the detection parameters from the memory. Consequently, detection parameters that are adapted to the positioning of the switching surfaces on the operating panel can be made available directly on the operating panel. In this way, the implementation costs for the assembly of the operating element can be additionally reduced.

According to one embodiment, the marking of the switching surfaces on the operating panel comprises at least one of the following: an imprint of the operating panel, an imprinted film that is applied onto the operating panel or a structured surface of the operating panel. Accordingly, the operating panel consisting, for example, of plastic is directly imprinted, wherein the marking of the switching surfaces is realized due to the imprint. A correspondingly imprinted film may be alternatively or additionally applied onto the operating panel. It is furthermore possible to realize the marking of the switching surfaces by structuring, particularly mechanically structuring, the surface of the operating panel.

In other embodiments, a display element such as, for example, a multi-digit segment display may also be provided on the control module in order to provide the user with additional information, for example, on an operating state of the furniture control. For example, the sensor module accordingly features a corresponding recess, through which the display device protrudes. It would likewise be possible to provide a recess or a transparent area in the operating panel in order to ensure that the display device is visible from outside.

According to another embodiment, the sensor module and the operating panel are movably supported in the housing, wherein the operating element features at least one electromechanical switching element that can be actuated by a motion of the sensor module. The sensor module and the operating panel are designed, in particular, for an axial motion perpendicular or essentially perpendicular to the surface of the operating panel. The support is realized, for example, with a prestress generated by one or more springs. When the operating panel or the sensor module is respectively depressed, it is therefore possible to close an electric contact of the electromechanical switching element. In this case, the generation of the actuating signal for the furniture control may be dependent on the actuation of one of the switching surfaces, as well as on the simultaneous actuation of the electromechanical switching element.

In a special embodiment, the control module is designed for detecting an actuation of one of the switching surfaces based on sensor signals delivered by the sensor surfaces and for respectively generating a first actuation signal for the furniture control when the switching element is not actuated and a second actuating signal for the furniture control when the switching element is actuated based on a detected actuation of this switching surface.

The different variations of the generation of the actuation signals with and without actuation of an electromechanical switching element make it possible to provide more flexible operating scenarios.

In various embodiments with a display element, the control module is designed for displaying an adjustment of a connected furniture control that is assigned to the actuated switching surface by means of the display device when the first actuating signal is generated and for carrying out the adjustment of the furniture control that is assigned to the actuated switching surface when the second actuating signal is generated.

This enables a user of the operating element, for example, to initially have one possible action of the actuated switching surface displayed on the display device without actually carrying out this action. The displayed action is not actually carried out until the electromechanical switching element is additionally depressed and therefore actuated. The action consists, for example, of a certain height adjustment of an adjustable table such that the height to be adjusted is initially displayed to the user and the user has the option of actually selecting this action.

In another embodiment, the operating element furthermore comprises a vibration motor, wherein the control module is designed for activating the vibration motor when an actuation of one of the switching surfaces is detected. This makes it possible to provide the user of the operating element with haptic feedback that signals a successful actuation of the switching surface. This can be realized, in particular, on the operating elements, on which the operating panel is rigidly connected to the housing.

According to another embodiment, the control module features a connector, to which a key module with at least one electromechanical key can be connected. Consequently, it is possible to provide other switches that allow an individual adaptation of the operating element in addition to the switching surfaces on the operating panel that are evaluated by means of the sensor module. The control module may also feature several connectors in order to provide broader options with respect to the variations of key modules that can be connected. The operating panel preferably also covers the key module and features, for example, openings or flexible areas, through which or by means of which the electromechanical key of the key module can be actuated. In various embodiments, the key module may feature additional connectors that make it possible to connect other key modules.

In the described embodiments, an arbitrary number of sensor surfaces that is only limited by the processing capacity of the microcontroller may be provided on the sensor module without incurring additional costs for keys or components of the control module. The respective functions, for which these surfaces are used, only depend, for example, on the parameterization of the microcontroller and can be illustrated by means of a corresponding design of the operating panel surface, particularly the marking of the switching surfaces. Since it is also possible that combinations of several sensor surfaces are registered during the detection, a nearly arbitrary position of such a switching surface can be detected if the sensor surfaces are arranged close to one another. Accordingly, the design of the operating panel surface is not dependent on the arrangement of a key directly above the sensor surface. This makes it possible to individually distribute or shift the key arrangement, as well as the corresponding functions, over the entire surface of the operating panel.

According to one embodiment, an electrically adjustable piece of furniture with a furniture control and an operating element according to one of the above-described embodiments that is connected to the furniture control is proposed. Such an electrically adjustable piece of furniture consists, for example, of an electrically adjustable table, an electrically adjustable armchair or an electrically adjustable bed.

The housing of the operating element may be mounted on the electrically adjustable piece of furniture by means of a bracket, wherein the housing of the operating element may be mounted, for example, underneath a table top by means of a sliding device such that the operating element can be pulled out underneath the table top as needed. The housing may furthermore be designed for the installation into the electrically adjustable piece of furniture. For example, a table top or an armrest of a chair may be provided with a recess, into which the housing of the operating element is inserted.

BRIEF DESCRIPTION OF THE DRAWINGS

Several embodiments of the invention are described in greater detail below with reference to the figures. In this respect, elements that function or act identically are identified by the same reference symbols.

FIG. 3, which includes

FIG. 6, which includes

DETAILED DESCRIPTION OF ILLUSTRATIVE EMBODIMENTS

Figure 1:
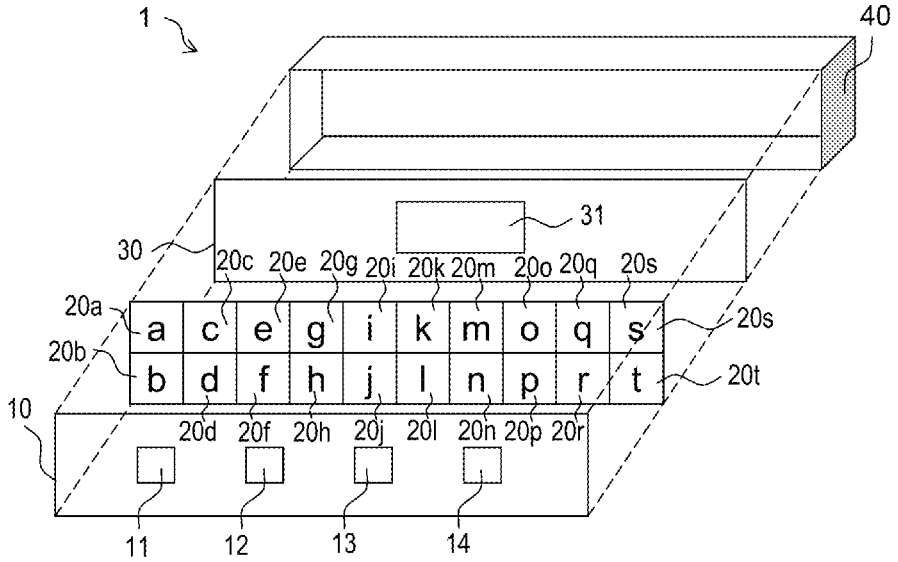
FIG. 1 shows an embodiment of an operating element.

FIG. 1 shows an embodiment of an operating element 1 for a furniture control for controlling an electrically adjustable piece of furniture, wherein this figure shows an exploded view in order to provide a better overview. The operating element 1 comprises an operating panel 10, a sensor module 20 and a control module 30 that are jointly inserted into the housing 40 of the operating element 1. The operating panel 10 furthermore forms a cover of the housing 40.

In the presently described embodiment, four switching surfaces 11, 12, 13, 14 are marked on the operating panel 10, wherein the number of switching surfaces merely represents an example and can be arbitrarily varied. The sensor module 20 has a flat design and features a plurality of sensor surfaces, namely twenty proximity-sensitive sensor surfaces 20*a* to 20*t* that are arranged on the sensor module 20 in the presently described embodiment. The number of sensor surfaces once again merely represents an example and can be varied. The sensor surfaces 20*a* to 20*t* respectively consist, for example, of an electrode and form a grid-like arrangement on the sensor module 20. Each of the electrodes may be formed by one or more layers of electrode material. Due to the electrodes, in particular, the switching surfaces 20*a* to 20*t* form a capacitive sensor.

The control module 30 features a microcontroller 31 that is designed, among other things, for evaluating sensor signals delivered by the sensor surfaces 20*a* to 20*t*. The markings of the switching surfaces 11, 12, 13, 14 respectively cover one or more sensor surfaces 20*a* to 20*t* such that a corresponding group of sensor surfaces is defined for each of the switching surfaces 11, 12, 13, 14 and completely or entirely covered by the respective switching surface. An evaluation of the sensor signals delivered by the sensor surfaces 20*a* to 20*t* therefore makes it possible to detect an actuation of one of the switching surfaces 11, 12, 13, 14, wherein an actuation signal for a not-shown furniture control can be generated in case an actuation is detected. The furniture control can convert the actuation signal, for example, into a motion of the electrically adjustable piece of furniture.

If a capacitive detection principle is used, for example, absolute capacitance values or relative changes of the capacitance value of the sensor surfaces can be evaluated in order to detect the proximity, e.g., of a finger of a user that actuates a switching surface. For example, when a finger approaches one of the respective electrodes or sensor surfaces, a slight capacitance is generated between the sensor surface and the finger and results in a corresponding sensor signal that is delivered to the control module by the sensor surface.

Figure 2:
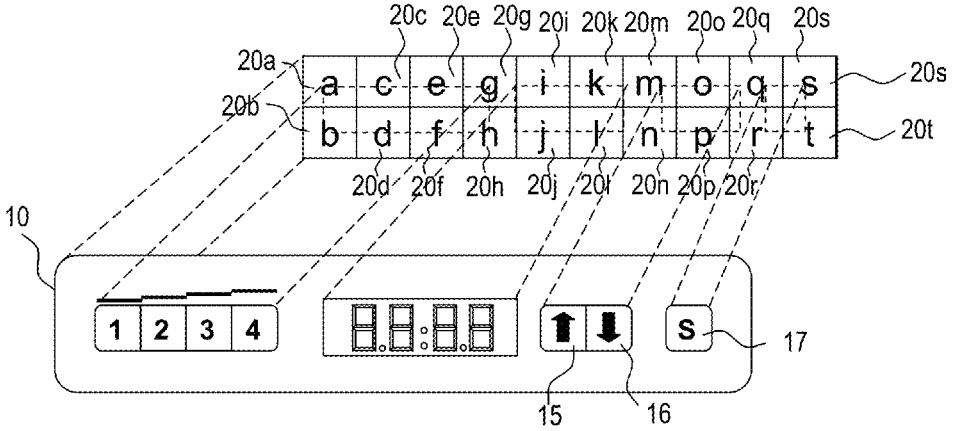
FIG. 2 shows an embodiment of an operating panel with a sensor module.

FIG. 2 shows an embodiment of an operating panel 10 with a sensor module 20 that can be alternatively used in the embodiment of an operating element 1 according to FIG. 1. The operating panel 10 features the switching surfaces 11, 12, 13, 14 that are identified by the numerals 1 to 4. Furthermore, a switching surface 15 that is identified by an arrow pointing upward, a switching surface 16 that is identified by an arrow pointing downward and a switching surface 17 that is identified by the letter S are marked on the operating panel 10. The operating panel 10 is also provided with an opening or a transparent area, through which a display device or a display is visible. In addition to the above-described switching surfaces 20*a* to 20*t*, the sensor module 20 accordingly features a recess, through which the display device can protrude.

On the sensor module 20, the positions of the switching surfaces are indicated on the operating panel 10 arranged thereon in order to elucidate the principle of detecting an actuation of one of the switching surfaces.

Accordingly, a group of sensor surfaces that belongs to the switching surface 11 comprises the sensor surfaces 20*a*, 20*b*, 20*c* and 20*d*. In the illustration of the sensor module 20, other groups that belong to the remaining switching surfaces 12 to 17 are formed in accordance with the same principle by the sensor surfaces that are at least partially covered by the corresponding switching surface.

The degree, by which one of the sensor surfaces is covered, also defines the capacitance value or the capacitance value range that is reached during an actuation of the switching surface lying thereon. Accordingly, it is possible to specify detection parameters that define a correlation between a switching surface and the corresponding group of sensor surfaces, the sensor signals of which serve for detecting the actuation of this switching surface. Such detection parameters can be specified for each switching surface of the set of switching surfaces 11 to 17. These detection parameters are respectively available, in particular, to the control module 30 or the microcontroller 31 for the evaluation of the sensor signals delivered by the switching surfaces 20*a* to 20*t*.

In various embodiments, the detection parameters can be stored in a parameter memory of the control module 30 or in the microcontroller 31, respectively. It is furthermore possible to provide such a parameter memory that contains the corresponding information and the parameters for the marked switching surfaces 11 to 17 directly in or on the operating panel 10. The parameters of the parameter memory of the operating panel 10 can be made available in the control module 30 by means of electric contacting or alternatively by reading out a transponder, for example, in accordance with the RFID principle.

It is furthermore possible to provide a programming and/or parameterizing interface on the control module 30, wherein this interface makes it possible, for example, to import detection parameters from a computer. For example, parameterization software is installed on the computer and generates the corresponding detection parameters based on defined switching surface positions. The interface used may consist of any known interface such as USB, infrared, Bluetooth or the like.

The actual operating program of the microcontroller 31 contains a detection algorithm that utilizes the stored detection parameters for evaluating the sensor signals and may be stored in a separate program memory. Such a program may be integrated, for example, in firmware of the control module.

The marking of the switching surfaces 11 to 17 on the operating panel 10 may be realized, for example, by directly imprinting the operating panel that is made, for example, of plastic. It would alternatively or additionally also be possible to utilize an imprinted film that contains the markings of the switching surfaces and is bonded or otherwise applied onto the surface of the operating panel 10. It would furthermore also be possible to realize the marking of the switching surfaces by designing the surface structure of the operating panel 10 accordingly, for example, by respectively milling in or milling out the markings or the switching surfaces.

According to the described principle, the design of the switching surfaces, particularly the positioning of the switching surfaces on the operating panel 10, can be realized variably and is not dependent, in particular, on the position of the sensor surfaces lying thereunder. This enables a user or a manufacturer of the operating element or of the electrically adjustable piece of furniture, on which the operating element is used, to select an individually designed operating interface.

FIG. 3 shows various other embodiments of an operating panel 10 that can be distinguished, for example, with respect to the shape of the operating panel, the number of switching surfaces and the arrangement of the switching surfaces.

Figure 3A:
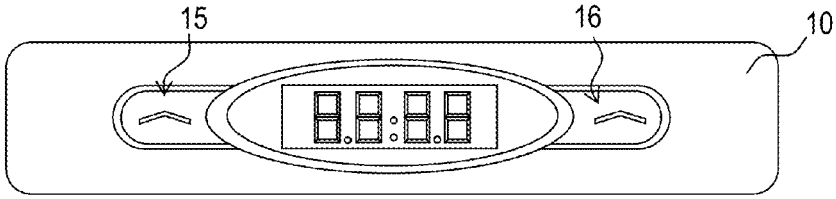
FIGS. 3A-3C, shows several embodiments of operating panels.

For example, FIG. 3A shows an operating panel 10, on which two switching surfaces 15, 16 are provided to the right and to the left of an area for a display device and respectively identified by an arrow pointing upward and an arrow pointing downward.

Figure 3B:
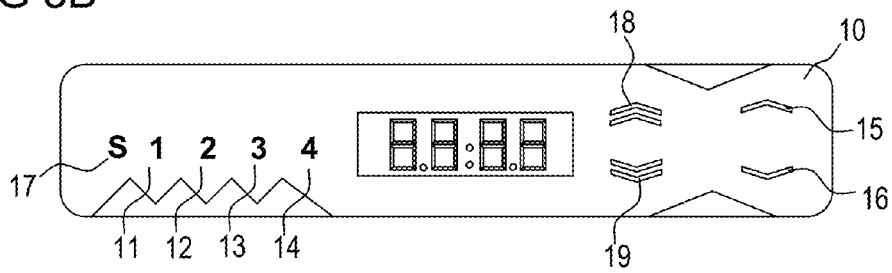

FIG. 3B shows an operating panel 10 with nine switching surfaces 11 to 19, wherein two other switching surfaces 18 and 19 identified by arrows are provided in addition to the above-described switching surfaces 11 to 17 in order to carry out additional switching processes. The marking of the switching surfaces 11 to 19 on the operating panel 10 is formed by the lettering with the corresponding symbols. The embodiment of the operating panel 10 illustrated in FIG. 3B also features an area, in which a display device can be arranged.

Figure 3C:
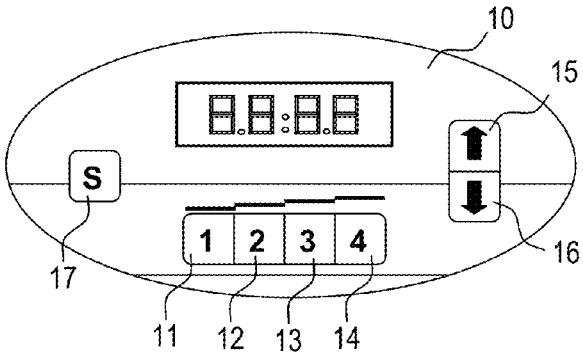

FIG. 3C shows another embodiment of an operating panel 10, in which an oval shape was chosen for the operating panel 10 in contrast to the above-described embodiments. Switching surfaces 11 to 17 are marked on the operating panel 10 adjacent to an area for a display device.

A corresponding detailed illustration of the sensor surfaces belonging to the switching surfaces illustrated in FIG. 3A, FIG. 3B and FIG. 3C is not provided. However, a corresponding group of sensor surfaces generally is defined for each of the marked switching surfaces, for example, together with a corresponding surface distribution over the sensor surfaces.

Figure 4:
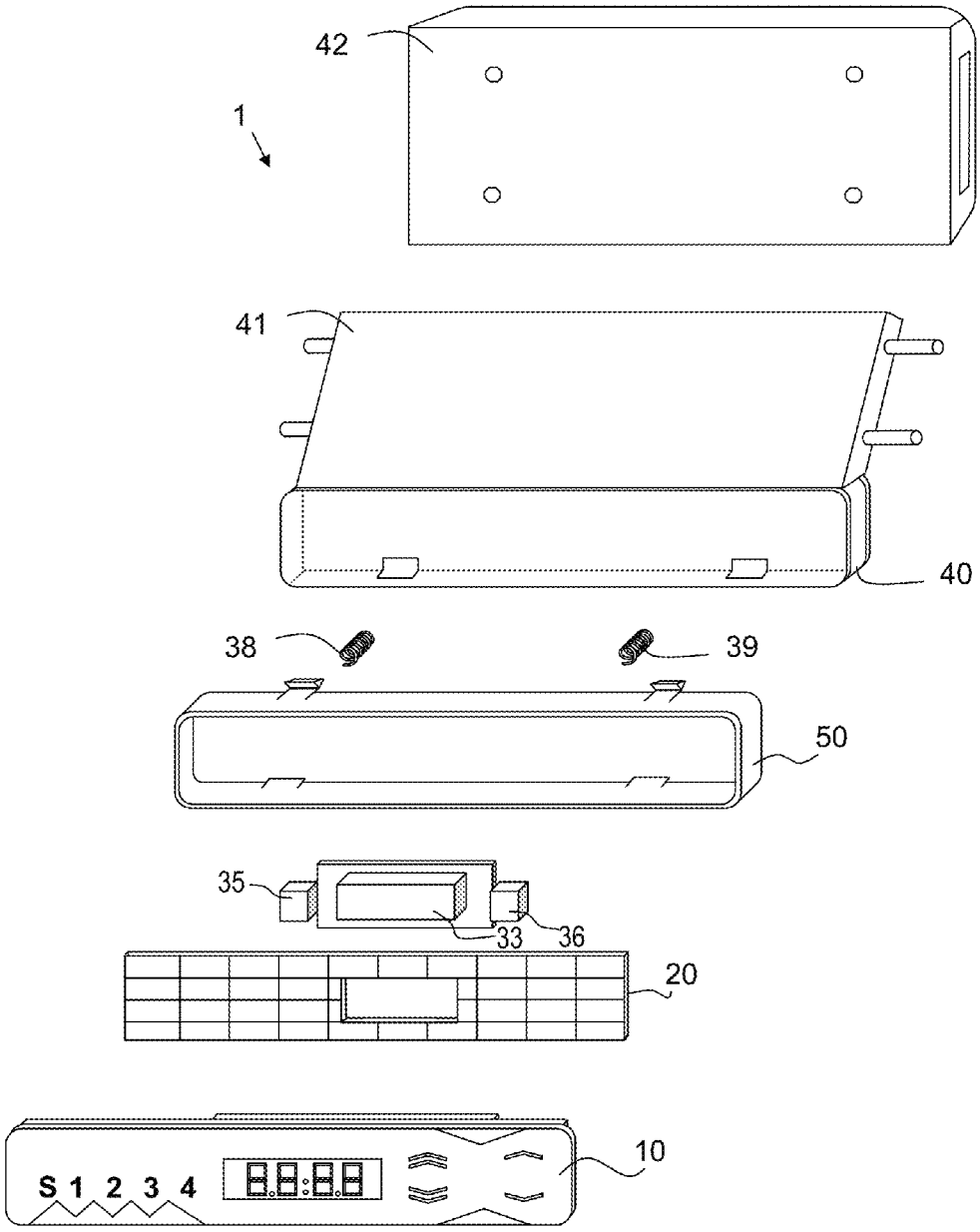
FIG. 4 shows another embodiment of an operating element.

FIG. 4 shows another embodiment of an operating element 1 that, in principle, is based on the embodiment illustrated in FIG. 1. With respect to functionally identical elements, we refer to the above-described embodiments.

A display device 33 such as, for example, a multi-digit segment display is additionally provided on the control module 30. The sensor module 20 accordingly features a corresponding recess, through which the display device 33 protrudes. The operating panel 10 is provided with a corresponding transparent area such that the display device 33 is visible from outside.

The operating element 1 and the control module 30 feature two electromechanical switches 35, 36 that are supported in the housing 40 by means of springs 38, 39. The operating element 1 furthermore features a holding frame 50 that serves, in particular, for supporting the operating panel 10 and/or the sensor module 20.

A mounting element 41 that can be movably supported in a bracket 42 with lateral notches is provided on the housing 40. The bracket 42 is designed, for example, for being mounted on a piece of furniture, particularly on the underside of a table top. Due to the movable support in the bracket 42, the operating element 1 or the housing 40 can be respectively pulled out underneath the table top as needed, for example, in order to carry out the desired adjustments.

Operating parameters or current adjustments or other information on a furniture control can be displayed to the user on the display device 33.

In the assembled state of the operating element 1, the operating panel 10 and the sensor module 20 are movably supported in the housing 40 by means of the switching element 35, 36 and the springs 38, 39, wherein the arrangement is prestressed by the springs 38, 39. During the operation of the operating element and an actuation of one of the switching surfaces of the operating panel 10, a corresponding actuation of at least one of the switching elements 35, 36 can be detected such that the control module 30 or the microcontroller respectively generates an actuation signal for a furniture control only in instances, in which the actuation of one of the switching surfaces was detected due to the evaluation of the sensor signals and one of the switching elements 35, 36 is actuated. The actuation of the electromechanical switching elements 35, 36 preferably can be optically and/or acoustically perceived by the user, for example, in the form of clicking during the actuation of the switching element. In this way, the ease of operation and the operational safety for the user are improved.

The generation of actuation signals with and without actuation of at least one of the switching elements 35, 36 can also be combined. For example, the control module 30 is designed for detecting an actuation of one of the switching surfaces based on sensor signals delivered by the sensor surfaces 20*a* to 20*t* and for respectively generating a first actuation signal for the furniture control when the switching element 35, 36 is not actuated and a second actuating signal for the furniture control when the switching element 35, 36 is actuated based on a detected actuation of this switching surface.

In this embodiment with a display element 33, the control module 30 is furthermore designed, for example, for displaying a possible adjustment of a connected furniture control that is assigned to the actuated switching surface by means of the display device 33 when the first actuating signal is generated and for carrying out the adjustment of the furniture control that is assigned to the actuated switching surface when the second actuating signal is generated.

In an alternative or additional embodiment, the operating element 1 may also feature a vibration motor that is arranged, for example, in the region of the operating panel 10 or the sensor module 20, respectively. The vibration motor can be activated in order to once again provide the user with haptic feedback signaling an occurring actuation when the actuation of one of the switching surfaces is detected, namely with or without actuation of an electromechanical switch that is not absolutely necessary in such an embodiment.

Figure 5:
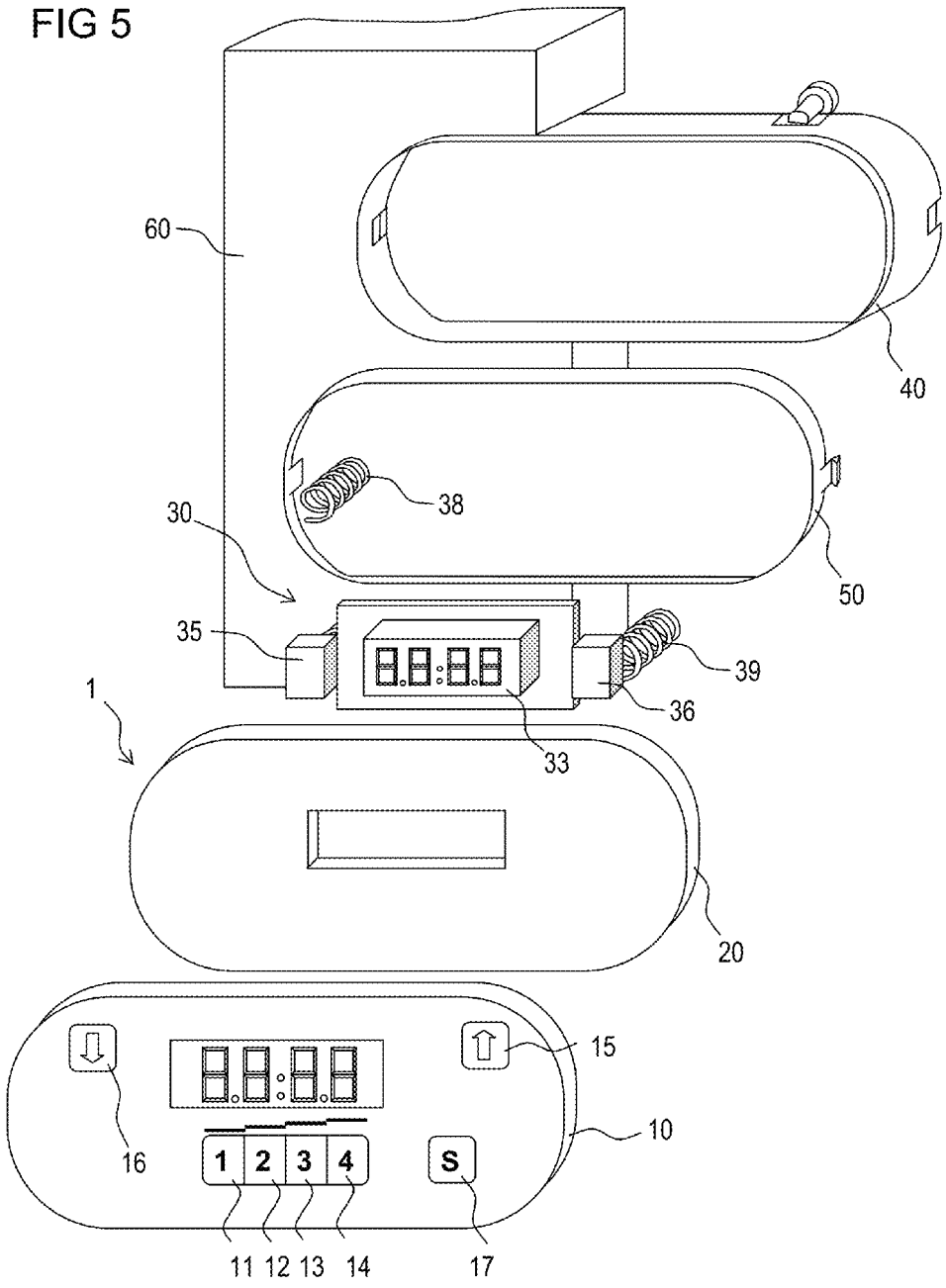
FIG. 5 shows yet another embodiment of an operating element.

FIG. 5 shows another embodiment of an operating element that essentially can be distinguished from the embodiment illustrated in FIG. 4 with respect to the shape and design of the housing 40. In addition, the operating element 1 illustrated in FIG. 5 is designed for being installed in a piece of furniture, wherein a recess, into which the housing 40 of the operating element 1 can be inserted, is provided in a table top 60 in this particular embodiment. With respect to the other elements illustrated in FIG. 5, we refer to the respective above-described embodiments of the operating element 1 and the operating panel 10.

FIG. 6 shows different embodiments of the control module 30, on which additional key modules are provided.

Figure 6A:
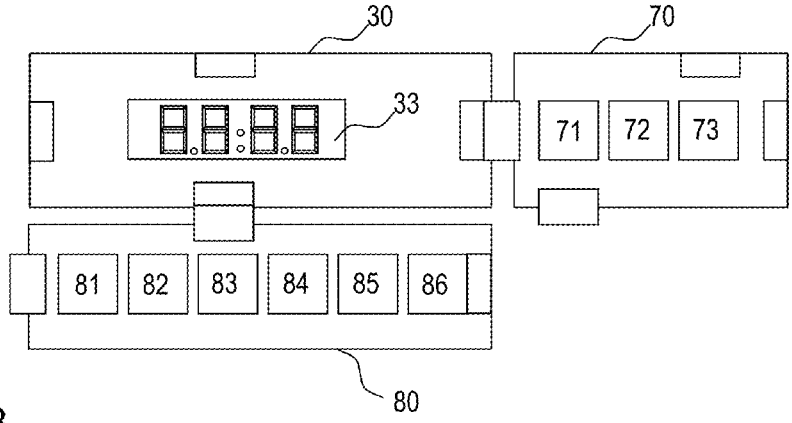
FIGS. 6A-6C, shows several embodiments of a control module with key modules.
Figure 6B:
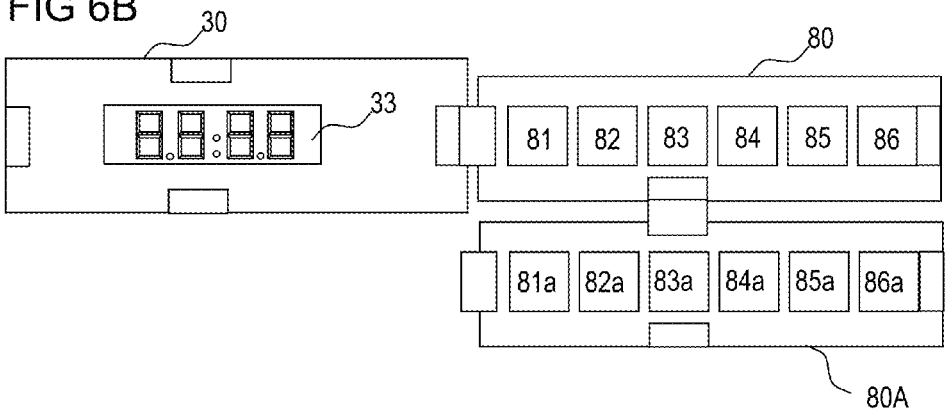

For example, FIG. 6A shows a control module 30 with a display device 33 arranged thereon. The control module 30 features connectors that are realized, for example, in the form of female connectors on each of its four edges or sides. A key module 70 on the right side and a key module 80 on the bottom side respectively feature a male connector at the corresponding locations and are connected to these connectors. Electromechanical keys 71, 72, 73 are provided on the key module 70 and electromechanical keys 81, 82, 83, 84, 85, 86 are provided on the key module 80.

An actuation of one of the keys 71 to 73 or 81 to 86 can be respectively evaluated by the control module 30 in order to forward a corresponding actuation signal to the furniture control. The additional key module 70 or the additional key modules 70, 80 is/are provided supplementary to the sensor module and the corresponding operating panel such that the respective key actuation can be detected by means of an evaluation of the sensor signals of the sensor module 30, as well as by means of signals of the key modules 70, 80. An operating panel 10 for such an arrangement preferably not only covers the sensor module 20, but also the key modules 70, 80 and accordingly features corresponding recesses or flexible areas, through which or by means of which the electromechanical keys can be respectively operated or actuated, in the area of the keys 71 to 73 and 81 to 86.

The key modules 70, 80 are also provided with other connectors that make it possible, for example, to connect additional key modules to a first key module. In the embodiment illustrated in FIG. 6B, for example, a second key module 80*a* with electromechanical keys 81*a* to 86*b* is connected to a bottom connector of the key module 80. The key module 80 is connected to the right side of the control module 30 in this embodiment.

Figure 6C:
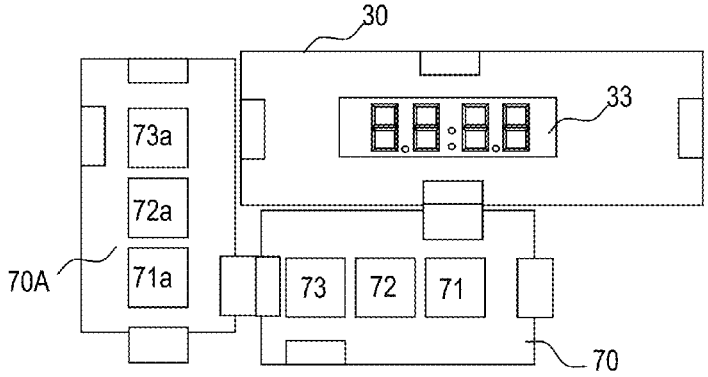

In another embodiment that is illustrated in FIG. 6C, a first key module 70 is connected to the bottom connector of the control module 30 while a second key module 70*a* with keys 71*a* to 73*a* is connected to the left side of the first key module in vertical orientation.

The ability to provide additional key modules with electromechanical keys makes it possible to further individualize the design of an operating interface of the operating element. A few different key modules 70, 80 make it possible, in particular, to realize different supplementary designs of the operating element 1 that are illustrated in an exemplary fashion in FIG. 6A, FIG. 6B and FIG. 6C.

In the described embodiments, an arbitrary number of sensor surfaces that is only limited by the processing capacity of the microcontroller may be provided on the sensor module without incurring additional costs for keys or components of the control module. The respective functions, for which these surfaces are used, only depend, for example, on the parameterization of the microcontroller and can be illustrated by means of a corresponding design of the operating panel surface, particularly the marking of the switching surfaces. Since it is also possible that combinations of several sensor surfaces are registered during the detection, a nearly arbitrary position of such a switching surface can be detected if the sensor surfaces are arranged close to one another.

The housing 40 of the operating element 1 can be mounted on an electrically adjustable piece of furniture such as, for example, underneath a table top by means of a sliding device such that the operating element can be pulled out underneath the table top as needed. The housing may furthermore be designed for the installation into the electrically adjustable piece of furniture. For example, a table top or an armrest of a chair may be provided with a recess, into which the housing of the operating element is inserted.

What is claimed is:

1. An operating element for a furniture control for controlling an electrically adjustable piece of furniture, the operating element comprising:

a flat sensor module with a plurality of proximity-sensitive sensor surfaces arranged on the sensor module;

an operating panel for covering the sensor surfaces, wherein a set of switching surfaces is marked on the operating panel;

a control module configured to detect an actuation of one of the switching surfaces based on sensor signals delivered by the sensor surfaces and to generate an actuation signal for the furniture control based on a detected actuation; and a housing, in which the sensor module and the control module are arranged, wherein the operating panel forms a cover of the housing, wherein the sensor module and the operating panel are movably supported in the housing, and wherein the operating element features at least one electromechanical switching element that is actuatable by a motion of the sensor module.

2. The operating element according to claim 1, wherein the sensor surfaces each feature a capacitive sensor.

3. The operating element according to claim 1, wherein the sensor surfaces are formed by a plurality of electrodes that are arranged on the sensor module in a grid-like fashion.

4. The operating element according to claim 1, wherein the sensor module is arranged between the operating panel and the control module.

5. The operating element according to claim 1, furthermore comprising a display device, wherein the sensor module features a recess, through which the display device protrudes.

6. The operating element according to claim 5, wherein the operating panel features an area for visualizing the display device.

7. The operating element according to claim 5, wherein the display device features a multi-digit segment display.

8. The operating element according to claim 5, wherein the display device is designed for displaying current adjustments and/or operating parameters of a connected furniture control.

9. The operating element according to claim 1, wherein each switching surface of the set of switching surfaces covers a group of sensor surfaces of the plurality of sensor surfaces.

10. The operating element according to claim 9, wherein each sensor surface of one of the groups of sensor surfaces is at least partially covered by one of the switching surfaces.

11. The operating element according to claim 1, wherein a marking of the switching surfaces on the operating panel comprises at least one of the following:

an imprint of the operating panel;

an imprinted film that is applied onto the operating panel; and a structured surface of the operating panel.

12. The operating element according to claim 1, further comprising a vibration motor, wherein the control module is designed for activating the vibration motor when an actuation is detected.

13. The operating element according to claim 1, wherein the control module is configured to detect an actuation of one of the switching surfaces based on an evaluation of a combination of sensor signals of the sensor surfaces.

14. The operating element according to claim 13, wherein a combination of sensor signals originates from a group of adjacent sensor surfaces.

15. The operating element according to claim 1, wherein the control module is designed for detecting an actuation of one of the switching surfaces based on detection parameters that define a correlation between each of the switching surfaces and a corresponding group of sensor surfaces, the sensor signals of which serve for detecting the actuation of this switching surface.

16. The operating element according to claim 15, wherein the operating panel features a memory configured to store detection parameters, and wherein the control module is designed for reading out the detection parameters from the memory.

17. The operating element according to claim 1, wherein the control module features a connector to which a key module that features at least one electromechanical key is connectable.

18. The operating element according to claim 1, wherein the control module is designed for detecting an actuation of one of the switching surfaces based on sensor signals delivered by the sensor surfaces and for respectively generating a first actuation signal for the furniture control when the switching element is not actuated and a second actuating signal for the furniture control when the switching element is actuated based on a detected actuation of this switching surface.

19. The operating element according to claim 18, further comprising a display device, wherein the sensor module features a recess, through which the display device protrudes, wherein the control module is designed for displaying an adjustment of a connected furniture control that is assigned to the actuated switching surface by means of the display device when the first actuating signal is generated and for carrying out the adjustment of the furniture control that is assigned to the actuated switching surface when the second actuating signal is generated.

20. An electrically adjustable piece of furniture with a furniture control and an operating element according to claim 1 that is connected to the furniture control.

21. An operating element for a furniture control for controlling an electrically adjustable piece of furniture, the operating element comprising:

a flat sensor module with a plurality of proximity-sensitive sensor surfaces arranged on the sensor module;

an operating panel for covering the sensor surfaces, wherein a set of switching surfaces is marked on the operating panel;

a control module configured to detect an actuation of one of the switching surfaces based on sensor signals delivered by the sensor surfaces and to generate an actuation signal for the furniture control based on a detected actuation; and a housing, in which the sensor module and the control module are arranged, wherein the operating panel forms a cover of the housing, wherein the control module is configured to detect an actuation of one of the switching surfaces based on an evaluation of a combination of sensor signals of the sensor surfaces.

* * * * *